US005657930A

United States Patent [19]

Battegazzore

[11] Patent Number: 5,657,930

[45] Date of Patent: Aug. 19, 1997

[54] ATOMIZER DEVICE FOR MANUALLY OPERATED PUMPS

[76] Inventor: Piero Battegazzore, Via Galileo Galilei, 74-15100 Alessandria, Italy

[21] Appl. No.: 398,914

[22] Filed: Mar. 6, 1995

[30] Foreign Application Priority Data

Mar. 25, 1994 [EP] European Pat. Off. ..... 94830140

[51] Int. Cl.[6] ..... B05B 9/043

[52] U.S. Cl. ..... 239/333; 239/533.15; 239/570

[58] Field of Search ..... 239/333, 464, 239/490, 491, 533.15, 570

[56] References Cited

U.S. PATENT DOCUMENTS

| | | | |
|---|---|---|---|
| 2,717,178 | 9/1955 | Cornelius | 299/97 |
| 4,182,496 | 1/1980 | Burke | 239/492 |
| 4,183,449 | 1/1980 | Blake | 239/333 X |
| 4,365,751 | 12/1982 | Saito et al. | 239/490 X |
| 4,830,284 | 5/1989 | Maerte | 239/333 |
| 4,957,239 | 9/1990 | Tempelmann | 239/464 X |
| 5,156,304 | 10/1992 | Battegazzore | 222/341 |

FOREIGN PATENT DOCUMENTS

| | | | |
|---|---|---|---|
| 0289856 | 9/1988 | European Pat. Off. . | |
| 1486392 | 9/1968 | France | 239/333 |
| 2366068 | 4/1978 | France . | |

*Primary Examiner*—Lee W. Young
*Attorney, Agent, or Firm*—Medlen & Carroll, LLP

[57] ABSTRACT

An atomizer device for liquids pressurized by a manually operated pump, without pressurizers, comprises a nozzle with an obturator to which a plunger member is connected, The liquid pressurized by the pump acts on this plunger and moves the obturator against a spring, opening the nozzle. Interceptors, which allow the liquid to pass and consequently to be sprayed outwards only when the obturator has moved by a given amount, moving away from the nozzle and forming a predetermined chamber about the nozzle, are provided in the passage for the liquid to the nozzle. The uniformity of the fan of the jet of liquid within the course of each operating cycle of the pump and its constancy in the different cycles is thus ensured.

3 Claims, 4 Drawing Sheets

ATOMIZER DEVICE FOR MANUALLY OPERATED PUMPS

FIELD OF THE INVENTION

The present invention relates to an atomizer device for liquids which is pressurized by a manually operated pump.

BACKGROUND OF THE INVENTION

Atomizers for liquids pressurized by a manually operated pump basically comprise a hollow tubular support extending along a longitudinal axis and defining an internal cylindrical wall, with a first axial opening at one end for the intake of the liquid pressurized by the pump, and a second axial opening at the opposite end; a body provided with a nozzle arranged in correspondence with the second aperture and sealed tightly with the tubular support; an obturator, inside the support, for closing and opening the nozzle; a plunger member, cooperating with the cylindrical cavity in the tubular support, the plunger member being connected to the obturator for the axial movement thereof under the action of the pressure of the liquid determined by the pump; a guide sleeve for the obturator; a cavity through the sleeve and the body provided with the nozzle, the cavity facing the nozzle; a spring for urging the obturator against the nozzle and holding it closed with a predetermined resilient load; and a passageway for the liquid through the first aperture and the cavity facing the nozzle.

Atomizers having the aforementioned characteristics are well-known in the prior art, one example being illustrated in U.S. Pat. No. 2,717,178. Similar prior art structures are shown in U.S. Pat. Nos. 4,182,496 and 4,830,284. In all of the atomizers described in these documents, however, it is apparent that when the liquid to be delivered reaches a specific pressure, the obturator overcomes the resilient load of the spring and moves axially, thereby opening the nozzle. Unfortunately, with the nozzle open, the pressure exerted by the pump causes the liquid to be immediately discharged outside without any control. The pump, being manual, generates a pressure which can vary widely in the range of an operating cycle and which changes from cycle to cycle.

This disadvantage is made worse by the fact that, in the prior art devices mentioned above, delivery occurs while the cavity is upstream of the nozzle and in the process of shaping and varying its geometry as a result of the gradual withdrawal of the obturator against spring loading.

Indeed, it has been found that, particularly when manually operated pumps without pressurizers are used, if the liquid is delivered before the chamber upstream of the nozzle has adopted a specific geometry and has reached a specific minimum volume, depending on the type of liquid to be delivered, it is not possible to repeat the desired fan shape of the sprayed jet constantly.

For each actuating cycle of the pump, the liquid can, in fact, be delivered initially in the form of a compact squirt and then, when the pump pressure reaches its maximum in the actuating cycle, in the form of a fan-shaped spray, returning to a compact squirt again when the pump pressure drops to zero at the end of the operating cycle.

Accordingly, prior art atomizers suffer from a delivery problem in which the dimensions of the jet are neither constant nor uniform, with the result that there is an excessive consumption of liquid regardless of the surfaces sprayed.

SUMMARY OF THE INVENTION

In accordance with the present invention the atomizer device includes interceptor means operated by the obturator which keep it closed when the obturator is against the nozzle, and open it after a predetermined axial displacement of the obturator during the movement away from the nozzle.

Thus, the present invention creates a fan-shaped spray which is uniform during each manual operating cycle of the pump, and which is as constant as possible from one cycle to the next even when the pump does not have liquid pressurizing devices for equalizing its pressure during the pumping process.

DETAILED DESCRIPTION OF THE INVENTION

With reference to the above drawings, a pump of the type without pressurizers and manually operated by a trigger 2 and a return lever 3, is generally designated 1.

Figure 1:
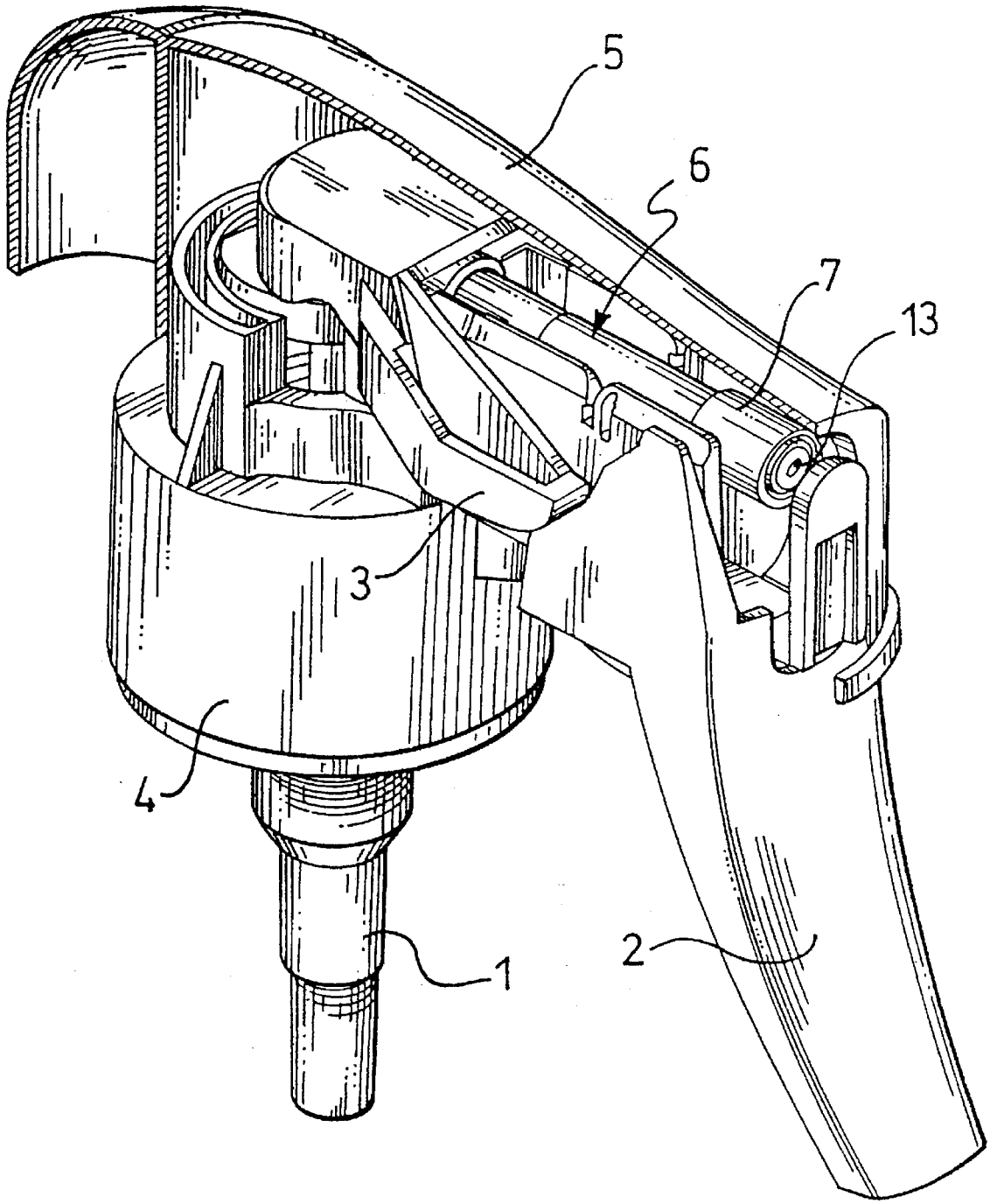
FIG. 1 shows a schematic view of a pump-atomizer unit.

The pump, which is conventional, has a collar 4 for attachment to a container, not shown, for the liquid to be sprayed, and with a hood 5, shown partially in section in FIG. 1, for protecting the mechanisms and for housing the atomizer device, generally indicated 6.

Possible further details of this pump and its operating mechanisms are to be found in U.S. Pat. No. 5,156,304.

Figure 2:
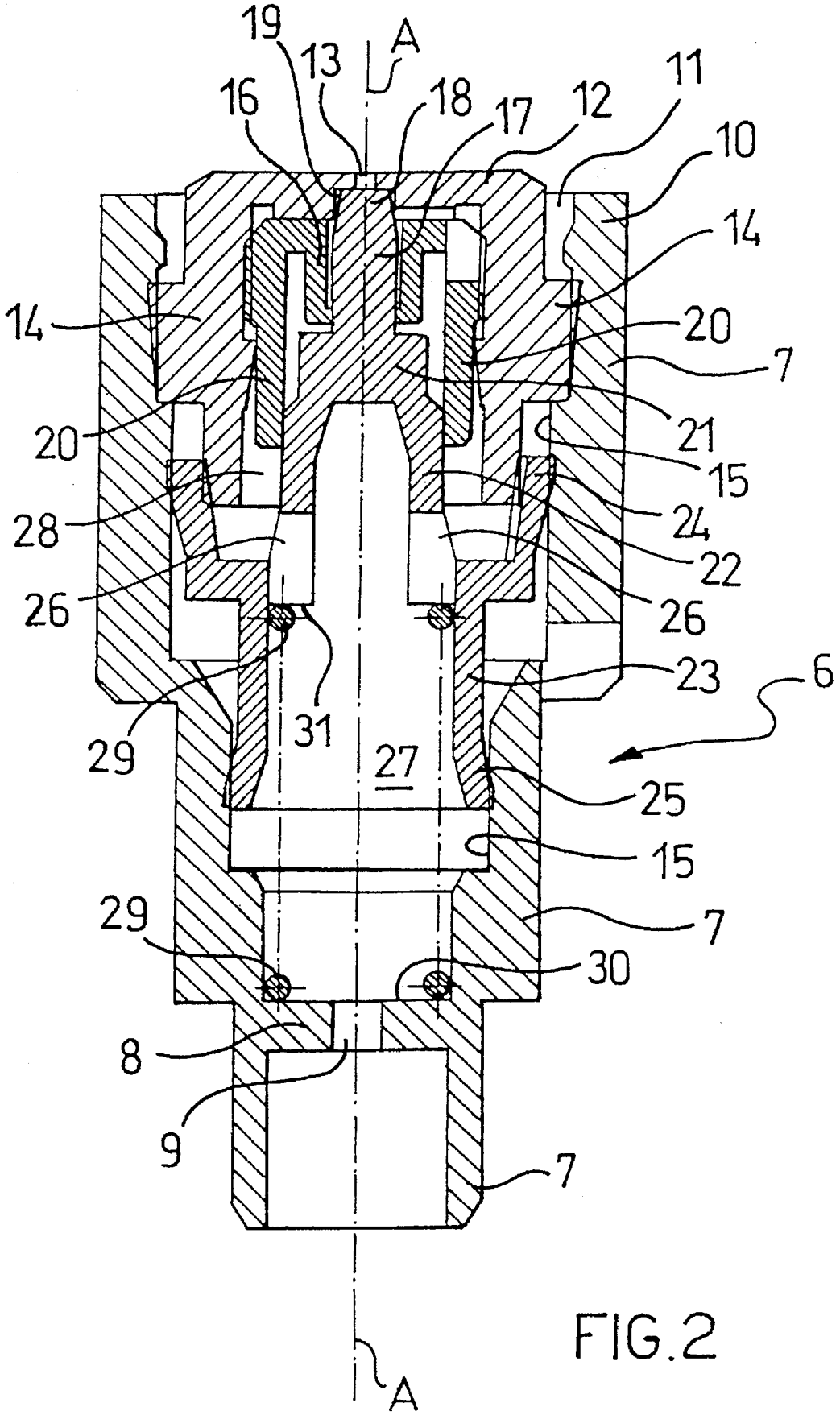
FIG. 2 shows a view in longitudinal section of the atomizer according to the invention with the obturator in the closed position.

With reference to FIG. 2, it will be noted that the atomizer device 6 comprises a tubular support 7 which extends along the longitudinal axis A—A. At its end 8, this support has a first axial opening 9 through which the liquid to be atomized enters, forced in cycles by the pump 1.

The other end 10 of the support 7 has a second axial opening 11 accommodating the body 12 carrying the nozzle 13.

The body 12 has an axial tubular extension 14 by means of which it is connected to the cylindrical inner wall 15 of the support 7 thus providing a tight seal.

A sleeve 16 for guiding the obturator 17 which, in the closed position illustrated in FIG. 1, has its end 18 against the nozzle 13 in the cavity 19 in the body 12 and surrounds the nozzle 13, is mounted in a position which is concentric with the axis A—A inside the tubular extension 14 of the body 12.

The guide sleeve 16 has a tubular extension 20 which is connected externally to the tubular extension 14 and, internally, defines a cylindrical cavity the diameter of which is larger than the diameter of a first axial portion 21 of the obturator 17 and equal to that of the further axial portion 22 of the same obturator, facing the opening 9 of the tubular support 7.

Associated with the axial portion 22 of the obturator is a plunger member 23 which is hollow on the interior and the annular lips 24 and 25 of which sealingly engage the cylindrical inner surface 15 of the support 7.

The plunger member 23 has radial apertures 26 which put the interior 27 of the support 7 into communication with the cavity 28 surrounding the portion 22 of the obturator.

A spring 29, acting between the shoulder 30 of the support 7 and the shoulder 31 of the plunger member 23, holds the obturator 17 in the closed position of the nozzle 13 with a predetermined resilient load.

Figure 3:
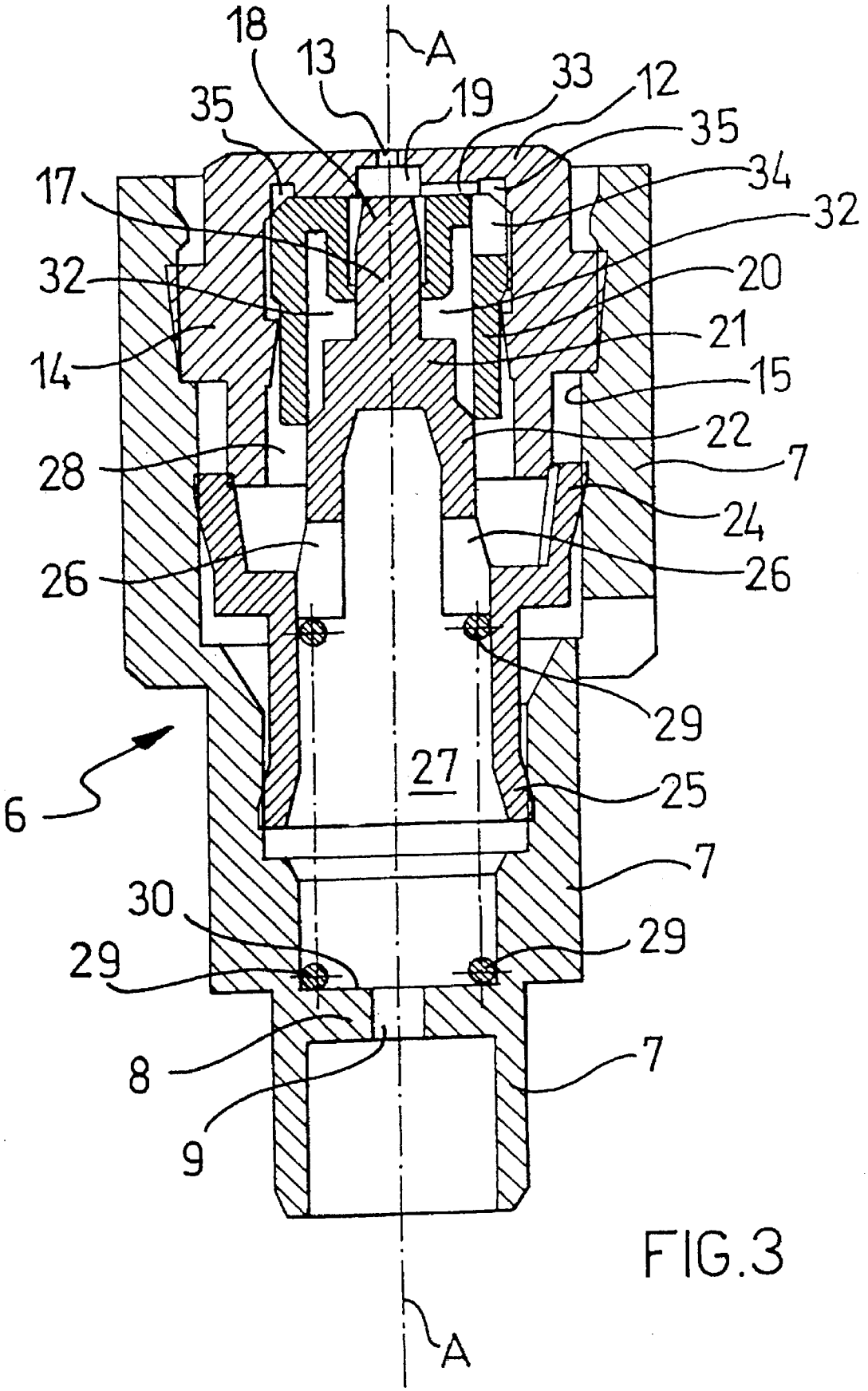
FIG. 3 shows a view in section, like the preceding drawing, with the obturator moved away from the nozzle but with the path for the liquid still closed.

With particular reference to FIG. 3, it can be seen that the cylindrical cavity 32 of the tubular extension 20 is put into communication with a plurality of radial channels 33 of the body 12 by means of the aperture 34 and an annular groove 35.

These radial channels 33 in turn communicate with the cavity 19 surrounding the nozzle 13 and serve to form a fan-shaped spray according to methods well known in the art.

Figure 4:
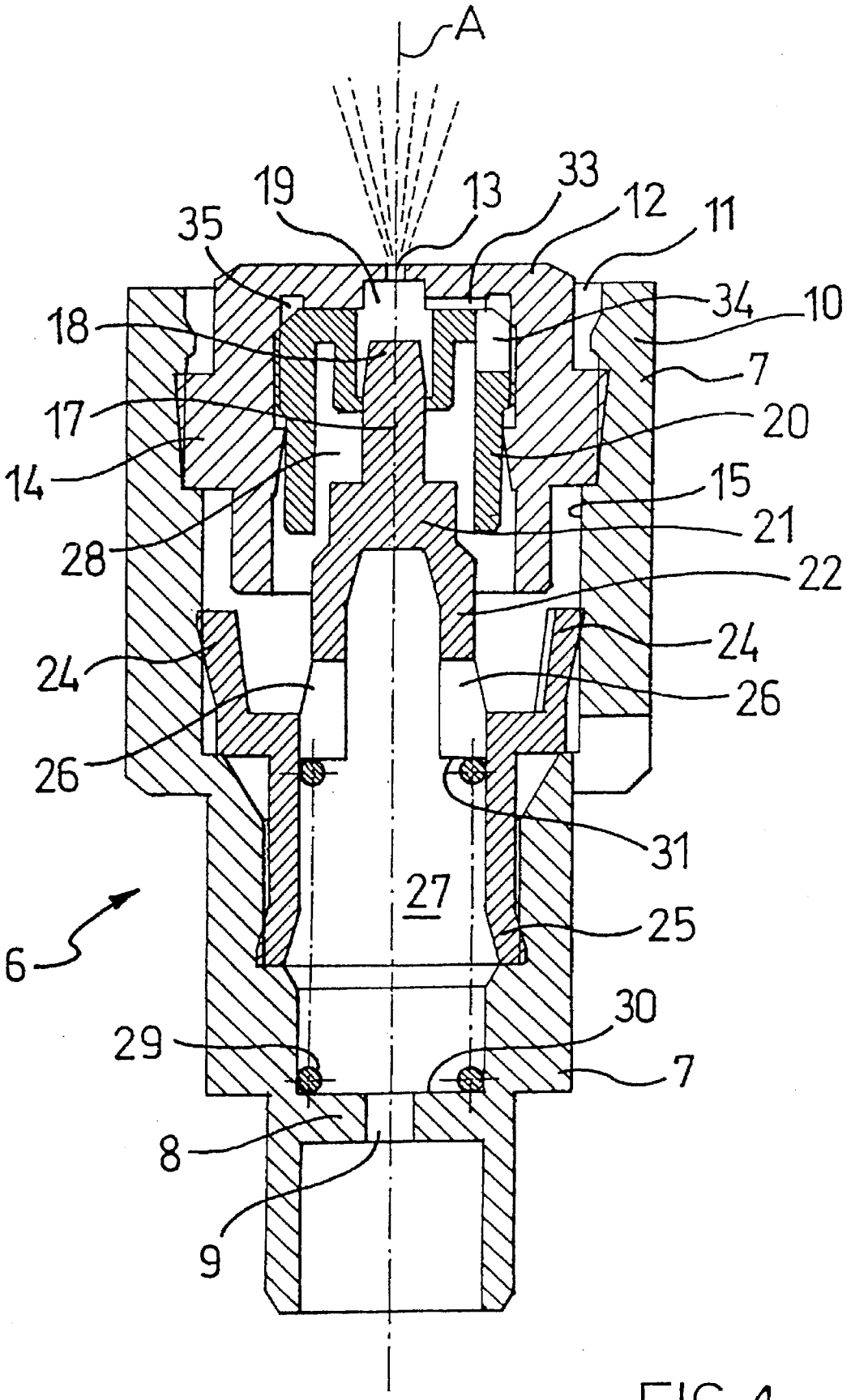
FIG. 4 shows a view in section, as in the preceding drawings, with the nozzle open in the spraying state.

As can be seen with particular reference to FIG. 4, the axial cavity 27 in the support 7, the radial apertures 26 in the plunger member 23, the cavities 28 and 32, the aperture 34, the annular groove 35 and the radial channels 33 constitute a passageway for the liquid to be atomized, which puts the aperture 9 into communication with the nozzle 13.

In this passageway, the atomizer according to the invention provides for the presence of interception devices which, in the example illustrated, consist of the axial portion 22 of the obturator and of the tubular extension 20 of the guide sleeve 16.

In the closed position of the nozzle shown in FIG. 2 and in the open position of the nozzle, with the obturator withdrawn outside the cavity 19 surrounding the nozzle, the portion 22 is, in fact, always sealingly engaged with the inner wall of the tubular extension 20 in spite of the movement of the obturator and the opening of the nozzle.

The interception of the passageway is interrupted and the liquid can reach the nozzle 13 from which it is sprayed outwards by the action of the pump only in the position illustrated in FIG. 4, in which the obturator is subsequently withdrawn and the first axial portion 21 of the obturator is opposite the cavity 28.

As can be seen from the above, during its use, the atomizer does not deliver any liquid until, by the manual operation of the pump trigger 2, not only is sufficient pressure reached to overcome the thrust of the spring 29 and the friction associated with the plunger member 23 and to disconnect the obturator 17 from the nozzle 13 so as to open it, but a minimum displacement is reached which is predetermined by the obturator such that the cavity 19 about the nozzle is also released, the geometry of which cavity is provided so as to be sufficient to ensure that the jet of liquid delivered is fan-shaped.

At the same time, during the course of the operating cycle of the trigger 2, the pump has reached the point at which it imparts a sufficiently high pressure to the liquid for it to be ejected in the form of a spray.

Thus, with the atomizer according to the invention it is possible to use manual pumps, even of the type with a trigger and without pressurizers, which are simple and economic, making the best use of the levels of the pressure generated as a function of the movement of the operating trigger in every operating cycle.

The invention permits numerous modifications and variants, in particular in connection with the means for intercepting the passageway for the liquid between the aperture 9 and the nozzle 13.

In a possible alternative embodiment, these means can consist, for example, of radial holes passing through the tubular extension 20 which are covered and uncovered by the portion 22 of the obturator during its axial movement without moving this portion 22 beyond the extension 20.

I claim:

1. An atomizer device for liquids pressurized by a manually operated pump, comprising:

a hollow tubular support extending along a longitudinal axis (A—A) and defining an internal cylindrical wall with a first axial aperture disposed at one end, for the intake of liquid pressurized by the pump, and a second axial aperture disposed at the opposite end;

a body provided with a nozzle positioned in correspondence with the second axial aperture and tightly sealed with the internal cylindrical wall defined by the hollow tubular support;

an obturator, inside the hollow tubular support, for closing and opening the nozzle;

a plunger member cooperating with the internal cylindrical wall of the hollow tubular support, the plunger member being connected to the obturator for the axial movement of the obturator under the action of the pressure of the liquid created by the pump;

a guide sleeve for the obturator;

a cavity formed by the sleeve and the body and surrounding the obturator;

a spring for urging the obturator against the nozzle and keeping it closed with a predetermined resilient load;

a passageway for the liquid between the first axial aperture and the cavity;

said passageway including interceptor means operated by the obturator which keep it closed when the obturator is against the nozzle and open it after a predetermined axial displacement of the obturator during the movement away from the nozzle.

2. An atomizer device according to claim 1, wherein said interceptor means comprise a tubular extension for the guide sleeve for the obturator coaxial with the obturator itself and facing the first aperture of the support, the tubular extension having an internal wall provided with a predetermined diameter, a first axial portion of the obturator having a diameter which is smaller than the internal diameter of the tubular extension and a second, likewise axial, portion of the obturator, following the first, towards the first aperture of the support, having a diameter equal to the internal diameter of the tubular extension so as to form a seal between the second portion of the obturator and the internal wall of the extension when the obturator is in the closed position and at least until the end of the predetermined axial displacement.

3. A device according to claim 1, wherein said cavity extends axially for a portion substantially equal to the predetermined axial displacement of the obturator.

* * * * *